United States Patent [19]

James, III

[11] 4,314,769

[45] Feb. 9, 1982

[54] ACOUSTICAL TONE GENERATOR

[75] Inventor: Edmund H. James, III, Lexington, Ky.

[73] Assignee: International Business Machines Corporation, Armonk, N.Y.

[21] Appl. No.: 155,289

[22] Filed: Jun. 2, 1980

[51] Int. Cl.[3] ..... B41J 1/30; B41J 29/46

[52] U.S. Cl. ..... 400/144.2; 400/344; 400/705.3; 400/712

[58] Field of Search ..... 400/144.2, 144.3, 144.1, 400/117, 342, 344, 705, 706, 712, 705.1, 705.3; 318/685, 696

[56] References Cited

U.S. PATENT DOCUMENTS 4,178,108 12/1979 Kane ..... 400/144.2

FOREIGN PATENT DOCUMENTS 2830527 1/1980 Fed. Rep. of Germany ..... 400/712

OTHER PUBLICATIONS

*IBM Tech. Disc. Bulletin,* vol. 20, No. 5, Oct. 1977, p. 1890, by J. L. Regehr et al.

*IBM Tech. Disc. Bulletin,* vol. 22, No. 8A, Jan. 1980, p. 3052, by G. P. Olson.

*Machine Design,* Apr. 26, 1979, pp. 213-217, "Software for Stepping Motors", by B. C. Lafreniere.

*Primary Examiner*—Paul T. Sewell

*Attorney, Agent, or Firm*—John W. Girvin, Jr.

[57] ABSTRACT

In an impact typewriter/printer using a daisy wheel typefont a stepper motor for rotating said daisy wheel for character selection purposes and microprocessor facilities for controlling said stepper motor, means are provided for generating tones signalling the occurrence of predetermined events to be brought to the attention of the typist. For that purpose, the microprocessor facilities are used to detect and identify the occurring event and then generate a tone of a predetermined frequency by moving said stepper motor back and forth at given rates whereby the daisy wheel typefont is made to vibrate the surrounding air fluid and generate the acoustical tone.

4 Claims, 7 Drawing Figures

ACOUSTICAL TONE GENERATOR

FIELD OF THE INVENTION

This invention deals with typewriter/printers and more particularly with bells, buzzers or other acoustical tone generators used to signal the occurrence of special events associated with typing or printing.

BACKGROUND OF THE INVENTION

Typing or printing is usually performed serially by character on a line by line basis, each line extending on the record medium (sheet of paper) between left and right margins. When typing any language that reads from left to right, the typewriter is usually provided with means for automatically starting the typing at a fixed distance from the left edge of the record medium. The left margin will therefore be easily made parallel to that edge without requiring any further attention from the typist. However, because the number of characters in a print line may vary, the right margin will usually not be made automatically settable. Attention is required from the typist who will have a certain lattitude of adjustments for positioning the last character typed on each line. Conventional typewriters are usually provided with a bell which rings when the extreme right limit for printing is close to being reached, to call for the attention of the typist. The bell is generally bulky and relatively expensive and it would be desirable from a designer's point of view to avoid the needs for such a device and still provide means for performing the bell function.

SUMMARY OF THE INVENTION

It is a principle object of this invention to provide means for performing the bell function in a typewriter/-printer.

Another object of the invention is to provide means for implementing a typewriter bell function relatively inexpensively.

A more general object of the invention is to provide means for generating acoustical tones signalling predetermined events associated with typing or printing.

Yet another object of this invention is to provide means for generating acoustical tones for signaling predetermined events in a system using a processor controlled stepper motor.

Accordingly, the invention contemplates for the generation of predetermined acoustical tones in a machine using a computer controlled stepper motor which stepper motor is provided with a load susceptible of rotation in connection with the rotation of said stepper motor, by driving the motor back and forth at a given frequency selected for vibrating said load whereby the air surrounding said load is made to vibrate at a predetermined acoustical frequency.

The resulting sound will be used to signal the typist that a predetermined event has occurred which triggered the sound generation. In addition, if several different events have to be brought to the attention of the typist, a tone will be made available for each particular event. This multiple tone generation may be achieved, with a computer controlled stepper motor, at a relatively low cost by properly selecting the frequency used for driving the motor back and forth.

The foregoing and other objects, features and advantages of the invention will be apparent from the following more particular description of preferred embodiments of the invention, as illustrated by the accompanying drawings. Particularly, even though the subsequent specification might refer to typewriters only, it should be understood that the invention applies to printers as well as to other machines provided with a stepper motor.

DETAILED DESCRIPTION OF THE INVENTION

Figure 1:
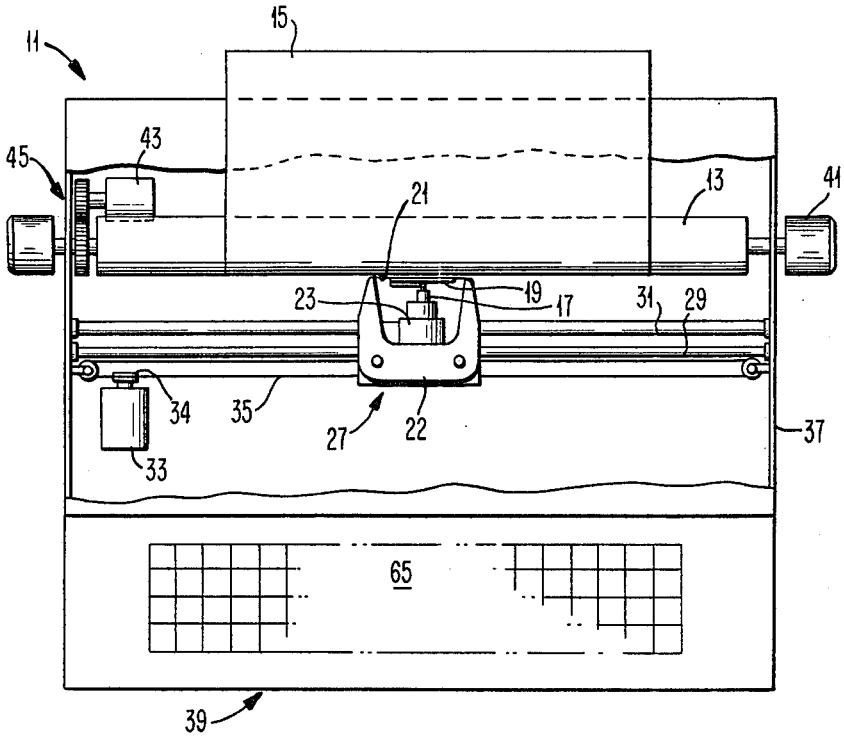
FIG. 1 is a perspective sketch of a typewriter/printer.

Referring now to the drawings, and more particularly to FIG. 1 thereof, a perspective sketch of a typewriter/printer 11 is shown.

Typewriter/printer 11, includes a platen 13 about which a print receiving medium such as a sheet of paper 15 may be wrapped to receive printing thereon. Printing is effected when the hammer unit 17 is actuated to force a selected type petal of the daisy wheel typefont 19 to strike the ink ribbon 21 which in turn strikes paper 15 creating an image. The ink ribbon is provided by a ribbon cartridge 22. The selection motor 23 effects character selection by rotating to effect the positioning of a selected type petal of the typefont 19 adjacent to the hammer unit 17.

The selection motor 23, ribbon 21, typefont 19 and hammer unit 17 are mounted on a print carrier 27 which moves over fixed guide rails 29 and 31 in a direction which parallels the length of platen 13. A carrier motor 33 effects the rotation of its output pulley 34 thereby effecting motion of a belt 35 which is wrapped thereabout. The belt 35 is connected to the print carrier 27 causing its corresponding motion along the length of the platen 13. Both the selection motor 23 and the carrier motor 33 are stepper motors.

A frame 37 supports the fixed guide rails 29, 31 and the platen 13. The typewriter/printer may also include a keyboard 39 which is also supported by the frame 37. The platen 13 may be rotated manually upon rotation of the platen knob 41 or automatically by a drive motor 43 connected to a gear train 45.

In operation, feeding the carrier motor 33 with signals provided by electronic and logic control circuitry (see FIG. 2) causes the carrier motor 33 to drive the belt 35 and move the print carrier 27 from left to right or vice versa along a print line direction and from one print position to the next. While the print carrier 27 is being shifted, the type font 19 is also rotated about its axis by the selection motor 13 for character selection purposes.

The two stepper motors, i.e., the selection motor 23 and the carrier motor 33 (see FIG. 2) are driven by driver circuits 47 and 49 respectively. Said driver circuits 47 and 49 are controlled by logic and program controlled elements comprising one master microprocessor 51 (Intel 8085), two separate slave microprocessors (Intel 8741) 53 and 55 and output ports 61 and 63 respectively. The slave microprocessors 53 and 55 are mainly devoted to controlling the movements of the selection motor 23 and the carrier motor 33 respectively.

In operation, any order which represents the move of either or both of the motors 23 or 33 during its execution is detected and reported to the master microprocessor 51 as a command applied to the status and data input I of said master microprocessor 51. The master microprocessor 51 identifies the command, defines the function to be performed and assigns specific jobs to the slave microprocessors 53 and/or 55. The master microprocessor 51 is also kept aware of the evolution of the functions being performed by the slave microprocessors 53 and/or 55, in order to be able to synchronize these functions with each other. Also, whenever one of the slave microprocessors 53, 55 either needs help from the master microprocessor 51 or has completed its task and is ready for performing another job, it lets the master microprocessor 51 know that it needs attention, in a conventional manner. For instance, a level raised on one of the lines of the corresponding bi-directional buses 60 or 62 will notify the master microprocessor 51 about the attention needed from its part, at a predetermined level of priority depending upon the characteristics of the help needed. The master microprocessor 51 will then establish connections with the concerned slave microprocessor 53 or 55 in due time, through one of the bi-directional buses 60 or 62.

Figure 2:
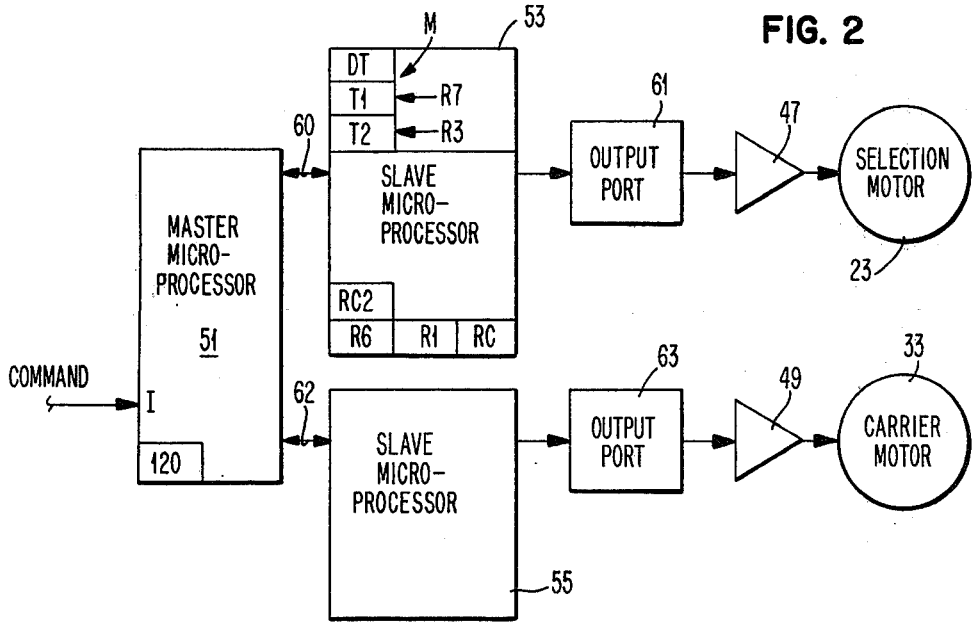
FIG. 2 represents electronic and logic control circuitry used within the typewriter/printer of FIG. 1.

Let's refer now to FIGS. 1 and 2. In normal typing operation the depressing of a character key 65 on the printer keyboard 39 is reported to the master microprocessor 51 through its status and data input I as a specific command detected and identified by the master microprocessor 51. Prior to any effective impact printing operation, the print carrier 27 has to be moved along the platen 13 to face the correct print position on the sheet of paper 15. This job is devoted to the slave microprocessor 55 controlling the carrier motor 33. In addition, the daisy wheel typefont 19 has to be rotated to present the selected petal to face the hammer unit 17. This function is devoted to the slave microprocessor 53 which controls the selection motor 23. The operations of both slave microprocessors 53 and 55 are initiated and synchronized by the master microprocessor 51. In other words, the stepper motors 23 and 33 are each individually controlled by a specific slave microprocessor 53 or 55, but both microprocessors are in turn controlled by the master microprocessor 51.

The tone generation looked for, will involve more particularly the operation of the selection motor 23 which will be described in detail further on.

Figure 3B:
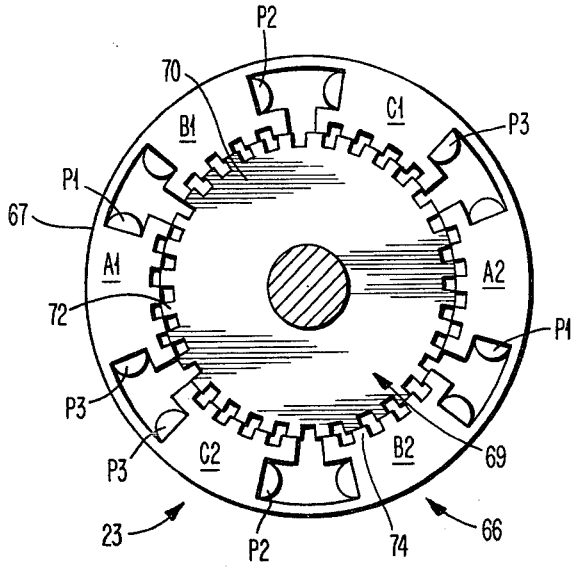
FIGS. 3A and 3B are detailed views of a stepper motor used with the typewriter/printer.
Figure 3A:
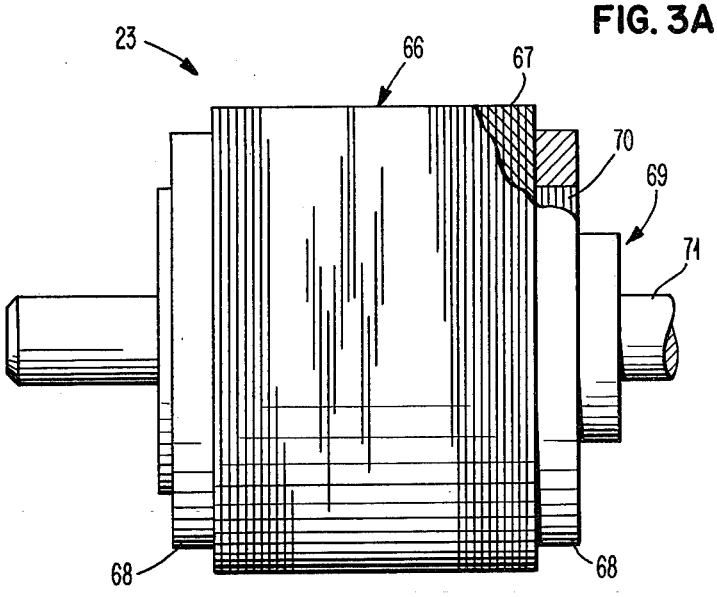

Referring to FIG. 3A and 3B, a schematic diagram of the 3-phase 96 step variable reluctance stepper motor 23 is represented. As shown in FIG. 3A, the selection motor 23 comprises a stator 66 and a rotor 69, respectively made of laminates 67 and 70. The laminates 67 and 70 are stacked and rigidly maintained together between two end caps 68. A motor shaft 71 is attached to be rotated by the rotor 69. FIG. 3B shows one stator laminate 67 and one rotor laminate 70. The stator laminate 67 is made to include six equally spaced salient poles A1, B1, C1, A2, B2, C2. The six poles of the stator 66 are each provided with a coil.

The coils on diametrically opposite located poles, i.e., A1-A2, B1-B2 and C1-C2, are connected together thus providing a phase coil P1 on A1-A2, P2 on B1-B2 and P3 on C1-C2. Each rotor laminate 70 is made to include 32 teeth 72 on its periphery. Each one of the salient poles A1, B1, C1, A2, B2 and C2 of the stator laminates 67 is provided with five teeth 74. The rotation of the selection motor 23 rotor 69 on a step by step basis is achieved by energizing, in other words by connecting to a d.c. power supply (not represented), two out of the three phase coils P1, P2 and P3 according to a predetermined sequence. Said sequence is defined by a phase table T1 stored in a location of the memory M of the slave microprocessor 53 (FIG. 2). Also stored in another location of the same memory M is a second phase table T2 for half step rotations of the selection motor 23.

| | T1 | | | T2 | | | |
|---|---|---|---|---|---|---|---|
| | P1 | P2 | P3 | P1 | P2 | P3 | |
| (R7)Pointer | 1 | 1 | 0 | 1 | 1 | 0 | Pointer(R3) |
| | 0 | 1 | 1 | 0 | 1 | 0 | |
| | 1 | 0 | 1 | 0 | 1 | 1 | |
| | | | | 0 | 0 | 1 | |
| | | | | 1 | 0 | 1 | |
| | | | | 1 | 0 | 0 | |

Phase table T1 includes three columns, one for each of the phase coils P1, P2 and P3, and three rows. Phase Table T2 includes the same three columns P1, P2 and P3 and six rows. A binary 1 in any one of the phase tables T1 or T2 indicates that the corresponding phase coil should be energized when the pointer R7 or R3 is pointing at the row. The selection motor 23 rotor 69 (see FIG. 3A and 3B) is made to rotate in a conventional manner, by shifting either one of the pointers R7 or R3 from one row to the next and energizing the phase coils pointed at. Whenever the selection motor 23 should switch from a step by step rotation to a by one half step rotation, or vice versa, the pointer position should be transferred from one phase table T1 or T2 to the other. In any case, the pointer R3 or R7 should indicate on the phase table being used, the phase coils energization scheme for the current location of the selection motor 23 rotor 69. A one row shift of pointer R7 on table T1 corresponds to a rotation of $360/96=3.75$ degrees of the rotor 69. A one row shift of pointer R3 corresponds to a $3.75/2=1.875$ degree rotation of same rotor 69.

Given an angular rotation $\theta$ in degrees to be performed by the selection motor 23, the master microprocessor 51 (see FIG. 2) derives the number N of steps to be performed:

$$N=\theta^{\circ}/3.75$$

N is loaded into a run counter RC of the slave microprocessor 53. The contents of RC is then decremented after each one step rotation of the selection motor 23 rotor 69. In addition proper acceleration and speed profiles to be achieved for performing the $\theta$ rotation most efficiently, are achieved by delaying the shifting operation of pointers R3 or R7, by a predetermined delay between step or half step move orders given to the selection motor 23. Accordingly, for each type of $\theta$ rotation made available to the system, a delay table is also stored into a memory location DT of the slave microprocessor 53. The operation of the selection motor 23 is achieved by converting the logic signals provided by the slave microprocessor into energy, using the driver circuit 47.

Figure 4:
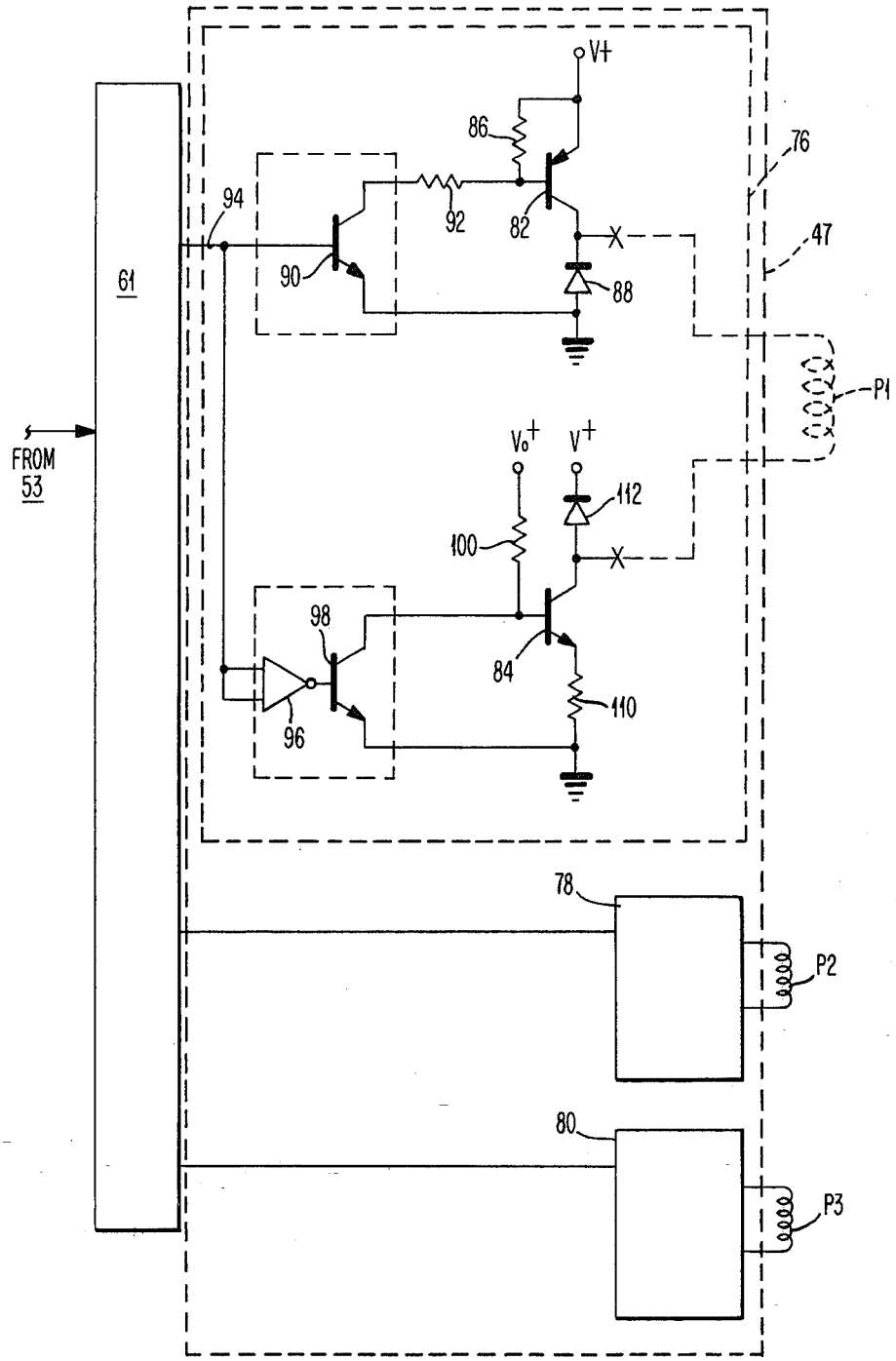
FIG. 4 shows a circuit arrangement to be used in connection with the typewriter/printer.

Referring now to FIG. 4, an arrangement of the driver circuit 47 (see FIG. 2) is represented. The driver circuit 47 is made of three identical power circuits 76, 78, 80, one for each of the phase coils P1, P2 and P3.

The power circuit 76 is shown in detail in FIG. 4. The phase coil P1 is connected between the collector electrodes of a PNP transistor 82 and an NPN transister 84. The emitter electrode of transistor 82 is connected to a power supply V+, and also to the base electrode of the same transistor 82 through a resistor 86. The collector electrode of transistor 82 is connected to ground through a diode 88. The base electrode of transistor 82 is connected to the collector electrode of an NPN transistor 90 through a resistor 92. The emitter electrode of transistor 90 is connected to ground. Its base electrode is connected to the output 94 of port 61. This same output 94 of port 61 is also connected, through an inverter 96, to the base electrode of an NPN transistor 98. The emitter electrode of transistor 98 is connected to ground. Its collector electrode is connected to the base electrode of transistor 84. The same base electrode of transistor 84 is also connected to a power supply Vo+ through a resistor 100. The emitter electrode of transistor 84 is connected to ground through a resistor 110. The collector electrode of transistor 84 is connected to the power supply V+ through a diode 112. Darlington amplifiers could conveniently be used in lieu of transistors 82 and 84.

In operation, when a logic up level is provided on the output 94 of the port 61 which port is in fact part of the slave microprocessor 53, the open collector outputs of transistors 90 and 98 are respectively turned low and high. Transistors 82 and 84 are both switched on into saturation. This enables energizing the phase coil P1 by providing a current path from the V+ d.c. source through transistor 82, the phase coil P1, transistor 84 and resistor 110 to ground. The phase coil P1 is thus energized and such energization will be maintained as long as the logic level on the output 96 is maintained in which means also at least as long as the pointer R3 or R7 (see FIG. 2) involved is not moved. When the logic level on the output 94 of port 67 is turned down, transistors 82 and 84 are switched off. During this part of the cycle, some of the energy present in the phase coil P1 field is returned to the V+ d.c. power supply via current flow through the now forward biased diodes 88 and 112.

During typing or printing operations, specific and predetermined events have to be reported to the typist. For instance, the typist must be made aware of the print carrier 27 (see FIG. 1) reaching a so called right margin position. In other words, when the print carrier 27 moving from left to right reaches a predetermined position along the platen 13, a signal should remind the typist that the printing is close to reaching the right edge of the sheet of paper 15. In conventional typewriters, a bell is used to perform the reminding function. Such a bell is bulky and relatively expensive, while the type of equipment described above is already available. Thus, the bell function (i.e., acoustical tone generation) may be replaced at almost no extra cost or space, using the process and system of this invention. In addition, several events other than right margin may be acoustically reported to the attention of the typist and with the equipment available. This also is implemented very efficiently by generating different acoustical tones for indicating different events. A non-exhaustive list of such events will be given further on as examples.

Figure 5:
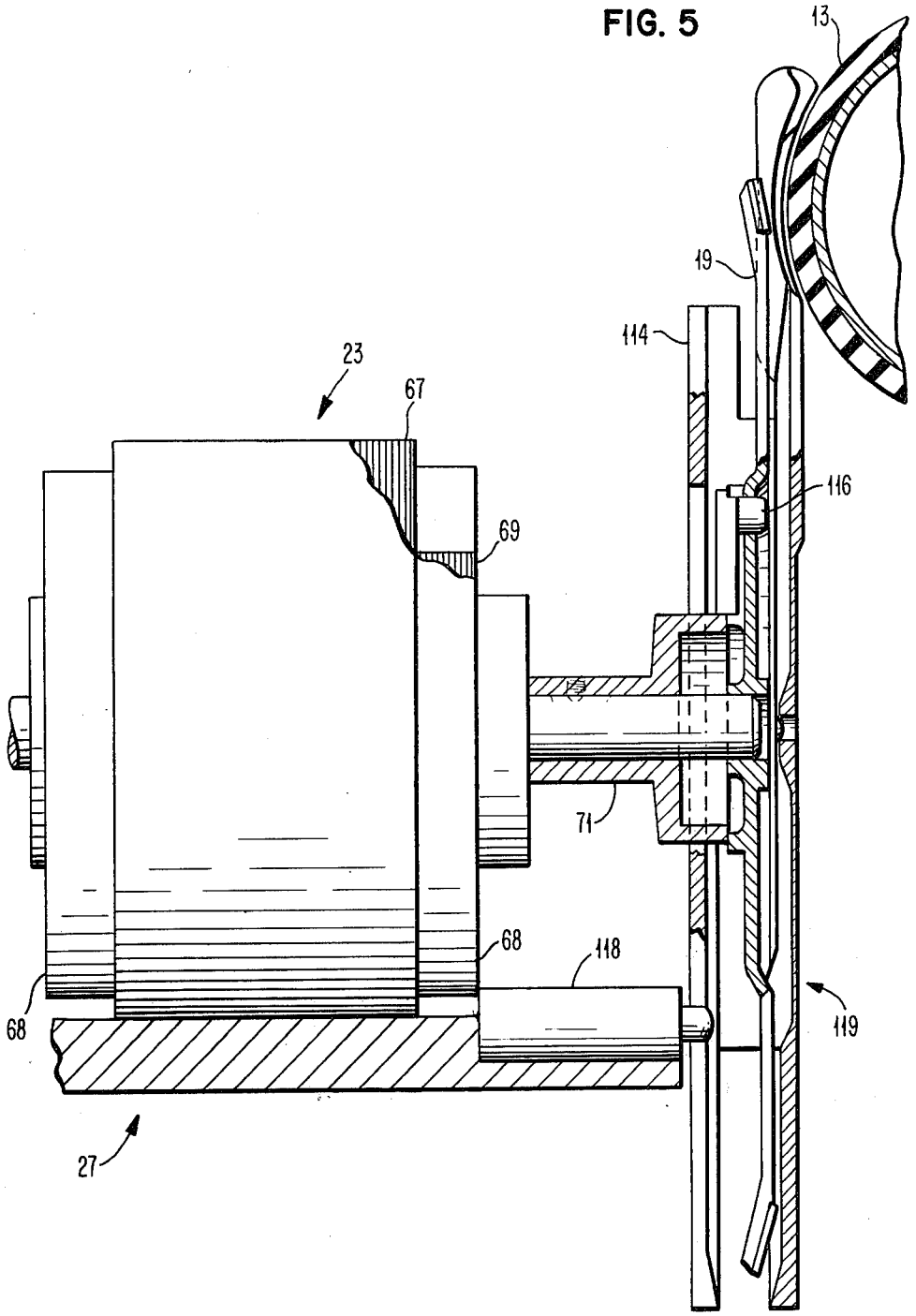
FIG. 5 shows a detailed view of the selection motor of the typewriter/printer with associated load.

Referring now to FIG. 5 of the drawing, a view of the selection motor 23 and of the daisy wheel typefont 19 in its cartridge 114 is represented. These elements are the major mechanical parts of the acoustical subsystem to be used for generating the various acoustical tones mentioned above. The selection motor 23 is represented showing the stator laminates 67, the rotor 69 and the motor shaft 71, with the latter engaging the daisy wheel typefont 19 (load) through a drive hub 116. The daisy wheel typefont 19 is located in a fluid environment (air) within the cartridge 114 used for convenience of typefont manipulation, e.g., removal, transportation, storage and insertion within the typewriter/printer 11 (not shown). Attached to the print carrier 27 and to the stator of the selection motor 23 is a cartridge securing hub 118 which is used to secure the cartridge 114 fixed relative to the daisy wheel typefont 19 while said daisy wheel typefont 19 is being rotated about its axis for character selection purposes. The tone generation will mainly result from controlled generation of periodical oscillations of the selection motor 23 inducing vibration of the cartridge 114 and the typefont 19 and vibrating the surrounding air in a controlled manner. The cartridge 114 and typefont 19 assembly therefore acts as a resonator 119 and will be referred to as such.

Generally speaking, mechanical vibrations, and potential acoustic waves, can be transmitted by one mechanical member to another member then to a surrounding fluid medium. To more efficiently generate these acoustic waves, basic acoustic properties should be taken into consideration. Compliance is a necessary requirement of the acoustical system for the vibration to be passed from one member to another. Higher compliance is better assured when the following requirements are met: (1) All mechanical members to be vibrated are securely fitted together so that minimizing of energy loss is achieved and, (2) the density of the transmitting medium multiplied by the speed of sound within said medium is greater than that of the medium to be transmitted to. Compliance between a fluid and a solid also has necessary requirements which are dependent on: (1) the density multiplied by the speed of sound of the transmitting medium is greater than same characteristics of the fluid which is to be transmitted to, and (2) the standing wave velocity in the transmitter is greater than the speed of sound of the fluid to be transmitted to. Even with these conditions of compliance, a necessary condition of transmission is sufficient vibratory amplitude to be audible. This should be coupled with the fact that the frequency of the vibration and the accompanying sounds are to be in a normal hearing range for the tone to be generated, while in contradistinction, minimum noise generation should be achieved throughout normal typing or printing operations.

Given the following definitions:

$\rho 1$: Average density of the material used for the rotor 69 of the selection motor 23.

C21: Speed of sound in the material used for the rotor 69 of the selection motor 23.

$\rho 2$: Average density of the material used for the resonator 119.

C22: Speed of sound in the material used for the resonator 119.

V2: Standing wave velocity in the resonator 119.

C23: Speed of sound in the air fluid surrounding the resonator 119.

K2: Radius of gyration of cross section area of the resonator 119.

I: Moment of inertia of the resonator 119.

m: Mass of the resonator 119.

$\omega 2/2\pi$: Frequency of the tone to be generated.

The mathematical equations to be met for a proper tone to be generated are:

$$\rho 1 \times C21 > \rho 2 \times C22 .$$

$$V2 = \sqrt{C22 \times K2 \times \omega 2} .$$

$$V2 > C23 .$$

$$K2 = \sqrt{I/m}$$

Figure 6:
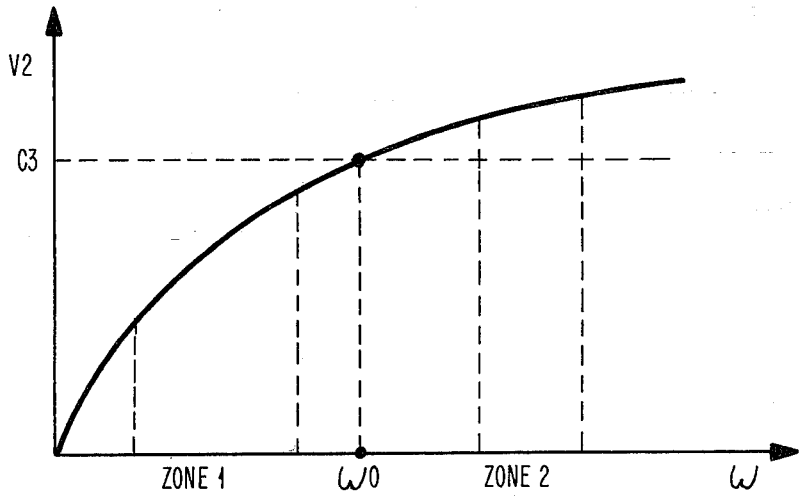
FIG. 6 shows a velocity versus frequency characteristics of the system of FIG. 5.

Referring now to FIG. 6, the standing wave velocity of the material used for the resonator 119, versus frequency at which said resonator 119 is made to vibrate is represented. The daisy wheel typefont 19 and cartridge 114 assembly presently used as resonator 119 have been disclosed in an application Ser. No. 968,287, filed Nov. 28, 1979, entitled "Font Changing Apparatus For Daisy Wheel Printer" and assigned to the same assignee as the present invention. The material selected for making the different parts of the resonator 119 are such that oscillations generated by said resonator 119 during normal typing or printing operations are inaudible by being under a threshold value $\omega o/2\pi$. The oscillations may for instance be of frequencies within Zone 1. While tone generation according to this invention are performed by operating at frequencies above $\omega o/2\pi$, e.g., within Zone 2.

Normally C23=343 m/s. Therefore, typical values of V2 during normal typing operation and related rotations of the selected motor 23 should be:

$$100 < V2 < 300 \text{ m/sec}$$

For tone generation, typical values of V2 would be higher than 343 m/s. For a system in which K2=1.5 cm and C22=$13\times10^4$ cm/s, then $$343 < \sqrt{13 \times 10^2 \times 1.5 \times 10^{-2} \times \omega}$$

$$\omega > 6033 \text{ rad/sec}$$

For each tone to be generated, a frequency $F=\omega/2\pi$ is selected. Then, the desired acoustical tone is made available by storing into the memory location for delay tables (DT zone) in slave microprocessor 53, a single duration (delay) value substantially equal to $\frac{1}{2}$ period, i.e., $\pi/\omega$. The tone is generated by driving the selection motor 23 back and forth with a given amplitude (e.g., on half step moves) with a $\pi/\omega$ delay between reversal of moves and this for a given period of time. In other words, adequate motor phase coil(s) ($\rho$1, $\rho$2 and/or $\rho$3), i.e., phase coils pointed at by pointer R3, will be energized for driving to selection motor 23 for a given move, e.g., a half step, in one direction. This energization will be maintained for a time duration (delay) equal to $\pi/\omega$. Then adequate phase(s) will be energized for substantially the same duration $\pi/\omega$, for driving the selection motor 23 for a same half step move in the reverse direction. For proper operation of the system $\pi/\omega$ should be smaller than the inverse of the selection stepper motor 23 natural frequency, e.g., $\pi/\omega<5$ ms. The reversal of each selection motor 23 move will therefore be started before completion of the half step move ordered.

If the selection motor 23 was being moved on a step by step basis prior to the tone generation being requested, the pointer position R3 used in connection with the phase table T2 should be matched with the pointer position R7 associated with phase table T1.

The only additional element which needs to be defined deals with the duration of the tone to be generated. This parameter is made available to the system, by having the master microprocessor 51 load the run counter RC with a given number and by decrementing said run counter RC contents after each half step move performed for tone generation. Said given number gives thus the total number of half step moves to be performed by the selection motor 23 for tone generation purposes. Fifty is a typical number the counter RC is to be loaded with.

Tone for signaling four particular events are made available in the typewriter/printer 11 of FIG. 1, i.e., right margin approach (tone frequency F1), end of memory approach (tone frequency F2), power down (tone frequency F3) and unsuccessful completion of operator request (tone frequency F4). For each tone frequency a single delay value (DT1, DT2, DT3 or DT4) needs to be stored into the delay table DT. The slave microprocessor 53 (see FIG. 2) discriminates between the four possible events by decoding the content of a register R6 loaded by the master microprocessor 51 after said master detects and identifies the event to be signaled. The master microprocessor 51 is itself made aware of the occurrence of one of the predetermined events by using detecting means, i.e., either an external source introducing a command on its status and data input I, or by an internal source. The external source uses a sensor for sensing the occurrence of the event. The master microprocessor acting as selecting means determines and selects the tone required after identifying the sensor involved. The internal source may be a counter. For instance, for right margin detection a counter 120 is provided within the master microprocessor 51 for keeping track of the movements of the carrier motor 33 (see FIG. 2). When a carrier 72 return (FIG. 1) is commanded, said counter 120 is loaded with the number of steps to be performed by the carrier motor 33 for the carrier 27 to reach the right margin position. The contents of counter 120 is decremented in accordance with the movement of the carrier motor 33 toward the right margin. A zero content in the counter 120 is reported by the master microprocessor 51 to the slave microprocessor 53, e.g., by storing into register R6 a code defining the tone to be generated. In other words, the slave microprocessor 53 knows then that tone generation is requested and which tone is involved. An interrupt level is raised on the input bus 60 and as soon as the slave microprocessor 53 is ready for satisfying the tone generation requested, a corresponding algorithm will be started. The information to be momentarily saved within the slave microprocessor 53 are saved in a conventional way, and the content of register R6 is decoded (Table 1. Also, the run counter RC is loaded with the number of half step moves to be performed for tone generation (e.g., fifty-one), the pointer R3 is adjusted and the correct delay table address (i.e., DT1 address for right margin approach to be signaled) within the memory location DT is addressed. Table 2 shows the program used for running the system using Intel microprocessor 8741 language. For a better understanding of the program shown in Table 2, comments have been added which will now be further defined:

| COMMENTS | DEFINITION |
|---|---|
| Set run counter to number of steps specified by bell command. | Fifty-one is loaded into run RC. |
| Set delay reg. (R1) to delay specified by bell command. | Register R1 within the slave microprocessor 53 is loaded with the delay (duration) value DT1. |
| Set half step phase pointer R3 to full step phase pointer. | The value of pointer R7 is used as value of pointer R3. |
| Do half step forward. | Half step forward move of selection motor 23. The pointer R3 is moved down to next row of phase table T2. |
| Call SYTOUTSTP | Subroutine for performing the delay operation defined by DT1 (this subroutine is further defined in the program, i.e., a timer RC2 within the slave microprocessor 53 is loaded with DT1 contents and decremented to zero). |
| Do half step reverse | Half ½ step backward move of selection motor 23. The pointer R3 is moved up to the next row position of phase table T2. |
| Decrement run counter | Contents of run counter RC is decremented by 1. |
| Repeat-Endrepeat | The subroutine between these two instructions is repeated until the contents of run counter RC equals zero. |
| Return to calling routine | Return to normal operation of the system (tone generation ends). |
| Step/delay look-up table | Delays stored in delay table Dt expressed in hexadecimal code divided by 750. |

The slave microprocessor 53 thus acts as a means for generating the acoustical tone selected by driving its load back and forth. For that purpose, the half step phase table T2 is addressed and the pointer R3 is made to point at a row defined in accordance with the position of pointer R7, which makes the driver 47 drive the selection motor 23 one half step in the forward direction. The pointer R3 is maintained in position for a time duration defined by the timer RC2, while the contents of counter RC is decremented by one unit. The pointer R3 is moved one row upward which makes the driver 47 drive the selection motor 23 one half step in the reverse direction. Again, the pointer is maintained in its position for same time duration (delay) defined by timer RC2, while the contents of counter RC is decremented by one unit. These half step back and forth rotations of the selection motor 23 make the motor 23 laminates vibrate while the daisy wheel 19 oscillates back and forth, and the resonator 119 vibrates the surrounding air fluid at a frequency substantially equal to the selected tone frequency.

While the invention has been particularly shown and described with reference to the preferred embodiments thereof, it will be understood by those skilled in the art that changes in form and details may be made therein without departing from the scope and spirit of the invention. For instance, in any machine provided with a stepper motor, any resonator designed according to the principles defined above could be attached to said stepper motor for tone generation purposes according to the invention. Also, tones of different amplitudes may be generated by varying the amplitude of the angle about which the stepper motor is being rotated back and forth for tone generation purposes. It should also be added that obtaining tones having the exact predetermined frequency values is irrelevant for the signaling function to be performed correctly. The tones need only be in the acoustical range and the delay values derived from the theory should only be used for defining tones at frequencies which at least proximates to the frequencies derived from the calculus.

TABLE 1

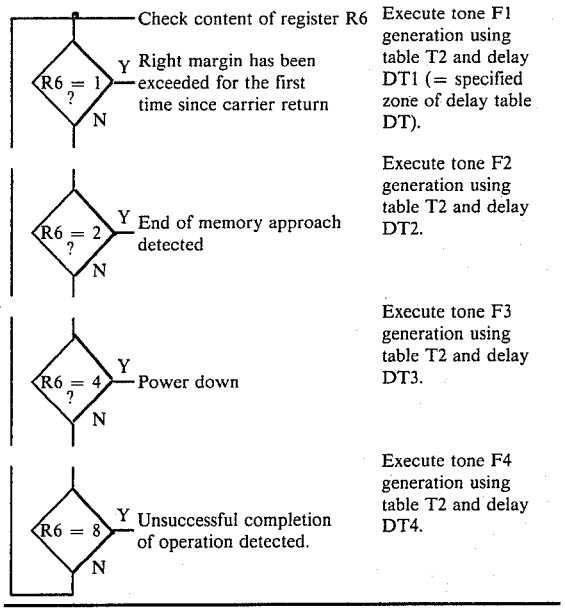

TABLE 2

```
2067 ***********************************************************************************************
2068 *                                                   1.  SET RUN COUNTER TO # STEPS SPECIFIED
2069 *                                                       BY BELL COMMAND;
2070 SYSLBELL    MOV A,R6
2071             MOVP A,@A
2072             MOV R4,A
2073 *                                                   1.  SET DELAY REG. (R1) TO DELAY SPECIFIED
2074 *                                                       BY BELL COMMAND;
2075             MOV A,R6
2076             INC A
2077             MOVP A,@A
2078             MOV R1,A
2079 *                                                   1.  SET HALF STEP PHASE TABLE POINTER (R3)
2080 *                                                       TO FULL STEP PHASE TABLE POINTER;
2081             MOV A,R7
2082             ADD A,X'00'
2083             MOV R3,A
2084 *                                                   1.  REPEAT
```

TABLE 2-continued

```
2085  *                                  2.  . DO HALF STEP FORWARD;
2086  SYZBLCYC   MOV A,R3
2087             CALL SYOUTSTP
2088  *                                  2.  . DO HALF STEP REVERSE;
2089             MOV A,R7
2090             CALL SYOUTSTP
2091  *                                  2.  . DECREMENT RUN COUNTER;
2092  *                                  1.  UNTIL RUN COUNTER = ZERO
2093             DJNZ R4,SYZBLCYC
2094  *                                  1.  ENDREPEAT;
2095  *                                  1.  RETURN TO CALLING ROUTINE;
2096             RET
2097  *                                  1.  GET NEW PHASE & OUTPUT TO MOTOR;
2098  SYOUTSTP   MOVP A,@A
2099             OUTL P1,A
2100  *                                  1.  LOAD 7 START TIMER;
2101             MOV A,R1
2102             MOV T,A
2103             STRT CNT
2104                                     1.  WAIT FOR TIMER TO EXPIRE;
2105  SYZOSWAI   JTF SYZOSSTP
2106             JMP SYZOSWAI
2107  *                                  1.  STOP TIMER & RETURN;
2108  SYZOSSTP   STOP TCNT
2109             RET
2110  *                                  1.  STEP/DELAY LOOKUP TABLE (COMMAND MAP);
2111             ORG X'01F0'
2112             DC X'84B8'
2113             DC X'78AE'
2114             DC X'6CA4'
2115             DC X'669E'
2116             DC X'5A92'
2117             DC X'4E84'
2118             DC X'4E7C'
2119             DC X'426C'
2120  ************************************************************************************
2121  *                                  ENDSEGMENT (SYSLBELL)
```

What is claimed is:

1. In a typewriter/printer comprising a daisy wheel typefont driven by a variable reluctance selection stepper motor having stacked laminates, and control means for controlling the rotation of said stepper motor, the improvement comprising means for generating at least one acoustical tone of predetermined frequency for signaling at least one predetermined event, including:

detecting means within said control means for detecting the occurrence of said predetermined event and for identifying this event;

selecting means responsive to said detecting means for selecting said at least one of said acoustical tones;

generating means within said control means and responsive to said detecting and selecting means, for generating the selected tone, said generating means including:

(a) means for driving the stepper motor for rotating said stepper motor in one direction;

(b) delay means responsive to said means for driving, for maintaining said driving during a given time delay which at least proximates to one over twice the frequency of the selected acoustical tone, said delay means including a delay table storing digitally coded delay values;

(c) means responsive to said delay means for subsequently driving the stepper motor for rotating said stepper motor in the reverse direction and during the same given time delay; and (d) control means connected to said means for driving, to said delay means and to said means for subsequently driving, for repetitively and sequentially controlling the operation of said means for driving, delay means and means for subsequently driving for a predetermined number of times;

whereby the daisy wheel is made to vibrate the surrounding air and generate said selected tone.

2. A printer according to claim 1 wherein said delay means includes a delay table storing one delay value for each of said acoustical tones of predetermined frequencies.

3. In an impact typewriter/printer system comprising a platen about which a print receiving medium is to be wrapped, a print carrier carrying a daisy wheel typefont located in a cartridge, a carrier motor for driving said print carrier along said platen, a selection stepper motor for rotating said daisy wheel typefont for character selection purposes, and microprocessor means for controlling said carrier motor and said selection stepper motor, the improvement of an acoustical tone generator including:

detecting means for detecting the occurrence of any one of predetermined events and for reporting it to said microprocessor means;

identifying means responsive to said detecting means and located within said microprocessor means for identifying the occurring event;

tone generating means responsive to said identifying means for generating an acoustical tone for signaling said occurring event, said tone generating means including:

(a) first means for driving said selection stepper motor for a half step rotation in one direction;

(b) second means responsive to said first means, for maintaining said driving during a predetermined time delay, said second means including a delay table within said microprocessor for storing delay values;

(c) third means, responsive to said second means, for subsequently driving said selection stepper motor for a half step rotation in the reverse direction;

(d) fourth means, responsive to said third means for maintaining said subsequent driving during same predetermined time delay;

(e) control means connected to said first, second, third and fourth means for repetitively and sequentially controlling the operation of same means for a predetermined number of times;

whereby the daisy wheel typefont and cartridge are made to vibrate the surrounding air and generate an acoustical tone of predetermined frequency.

4. In an impact typewriter/printer system according to claim 3, said delay table storing one delay value for each tone to be generated, said delay value being at least proximate to one over twice the frequency of the tone to be generated.

* * * * *